US005844351A

United States Patent [19]

Jones et al.

[11] Patent Number: 5,844,351

[45] Date of Patent: Dec. 1, 1998

[54] FIELD EMITTER DEVICE, AND VEIL PROCESS FOR THR FABRICATION THEREOF

[75] Inventors: Gary W. Jones, Poughkeepsie; Steven M. Zimmerman, Pleasant Valley; Jeffrey A. Silvernail, Kingston; Susan K. Schwartz Jones, Poughkeepsie, all of N.Y.

[73] Assignee: Fed Corporation, Hopewell Junction, N.Y.

[21] Appl. No.: 519,122

[22] Filed: Aug. 24, 1995

[51] Int. Cl.[6] ..... H01J 21/00

[52] U.S. Cl. ..... 313/310; 313/495; 313/355; 428/938

[58] Field of Search ..... 313/310, 309, 313/336, 351, 495, 306, 311, 496, 355; 428/938

[56] References Cited

U.S. PATENT DOCUMENTS

| | | |
|---|---|---|
| 2,926,286 | 2/1960 | Skellett . |
| 3,665,241 | 5/1972 | Spindt et al. . |
| 3,753,022 | 8/1973 | Fraser, Jr. . |
| 3,921,022 | 11/1975 | Levine . |
| 3,935,500 | 1/1976 | Oess et al. . |
| 3,970,877 | 7/1976 | Smith et al. . |
| 3,982,147 | 9/1976 | Redman . |
| 3,998,678 | 12/1976 | Fukase et al. . |
| 4,008,412 | 2/1977 | Yuito et al. . |
| 4,095,133 | 6/1978 | Hoeberechts . |
| 4,163,949 | 8/1979 | Shelton . |
| 4,164,680 | 8/1979 | Villalobos . |
| 4,256,532 | 3/1981 | Magdo et al. . |
| 4,277,883 | 7/1981 | Kaplan . |
| 4,307,507 | 12/1981 | Gray et al. . |
| 4,325,000 | 4/1982 | Wolfe et al. . |
| 4,337,115 | 6/1982 | Ikeda et al. . |
| 4,341,980 | 7/1982 | Noguchi et al. . |
| 4,498,952 | 2/1985 | Christensen . |
| 4,513,308 | 4/1985 | Greene et al. . |
| 4,578,614 | 3/1986 | Gray et al. . |
| 4,614,564 | 9/1986 | Sheldon et al. . |
| 4,663,559 | 5/1987 | Christensen . |
| 4,670,090 | 6/1987 | Sheng et al. . |
| 4,683,024 | 7/1987 | Miller et al. . |
| 4,685,996 | 8/1987 | Busta et al. . |
| 4,724,328 | 2/1988 | Lischke . |
| 4,774,433 | 9/1988 | Ikebe et al. . |
| 4,818,914 | 4/1989 | Brodie . |
| 4,824,795 | 4/1989 | Blanchard . |
| 4,853,545 | 8/1989 | Rose . |
| 4,900,981 | 2/1990 | Yamazaki et al. . |
| 4,934,773 | 6/1990 | Becker . |
| 4,964,946 | 10/1990 | Gray et al. . |
| 4,990,766 | 2/1991 | Simms et al. . |
| 5,012,153 | 4/1991 | Atkinson et al. . |

(List continued on next page.)

FOREIGN PATENT DOCUMENTS

| | | |
|---|---|---|
| 58-94741 | 6/1983 | Japan . |

OTHER PUBLICATIONS

Warren, John B. "Control of silicon field emitter shape with isotropically etched oxide masks," Inst. Phys. Conf. Ser. No. 99: Section 2, 1989, pp. 37–40.

*Primary Examiner*—Ashok Patel
*Attorney, Agent, or Firm*—Collier, Shannon, Rill & Scott

[57] ABSTRACT

A field emitter device formed by a veil process wherein a protective layer comprising a release layer is deposited on the gate electrode layer for the device, with the protective layer overlying the circumscribing peripheral edge of the opening of the gate electrode layer, to protect the edge of the gate electrode layer during etching of the field emitter cavity in the dielectric material layer on a substrate, and during the formation of a field emitter element in the cavity by depositing a field emitter material through the opening. The protective layer is readily removed subsequent to completion of the cavity etching and emitter formation steps, to yield the field emitter device. Also disclosed are various planarizing structures and methods, and current limiter compositions permitting high efficiency emission of electrons from the field emitter elements at low turn-on voltages.

10 Claims, 8 Drawing Sheets

U.S. PATENT DOCUMENTS

| | | |
|---|---|---|
| 5,030,895 | 7/1991 | Gray . |
| 5,053,673 | 10/1991 | Tomii et al. . |
| 5,063,327 | 11/1991 | Brodie et al. . |
| 5,070,282 | 12/1991 | Epsztein . |
| 5,129,850 | 7/1992 | Kane et al. . |
| 5,140,219 | 8/1992 | Kane . |
| 5,141,459 | 8/1992 | Zimmerman . |
| 5,141,460 | 8/1992 | Jaskie et al. . |
| 5,142,184 | 8/1992 | Kane . |
| 5,144,191 | 9/1992 | Jones et al. . |
| 5,164,632 | 11/1992 | Yoshida et al. . |
| 5,188,977 | 2/1993 | Stengl et al. . |
| 5,191,217 | 3/1993 | Kane et al. . |
| 5,204,666 | 4/1993 | Aoki et al. . |
| 5,216,324 | 6/1993 | Curtin . |
| 5,227,769 | 7/1993 | Leksell et al. . |
| 5,309,169 | 5/1994 | Lippert . |
| 5,313,137 | 5/1994 | Witty . |
| 5,371,433 | 12/1994 | Horne et al. . |
| 5,374,868 | 12/1994 | Tjaden et al. . |
| 5,384,509 | 1/1995 | Kane et al. . |
| 5,386,175 | 1/1995 | Van Gorkom et al. . |
| 5,406,170 | 4/1995 | Uemura et al. . |
| 5,457,356 | 10/1995 | Parodos . |
| 5,529,524 | 6/1996 | Jones ..... 445/24 |
| 5,534,743 | 7/1996 | Jones et al. ..... 313/309 X |
| 5,548,181 | 8/1996 | Jones ..... 313/309 |

FIELD EMITTER DEVICE, AND VEIL PROCESS FOR THR FABRICATION THEREOF

FIELD OF THE INVENTION

The present invention relates to field emission structures and devices, including field emission-based flat panel displays, as well as to methods of manufacture and use of such structures and devices.

BACKGROUND OF THE INVENTION

In the technology of field emission structures and devices, a microelectronic emission element, or a plurality (array) of such elements, is employed to emit a flux of electrons from one or more field emitters. The field emitter, which often is referred to as a "tip", is specifically shaped to facilitate effective emission of electrons, and may for example be conical-, pyramidal-, or ridge-shaped in surface profile.

Field emitter structures have wide potential and actual utility in microelectronics applications, including electron guns, display devices comprising the field emitter structure in combination with photoluminescent material on which the emitted electrons are selectively impinged, and vacuum integrated circuits comprising assemblies of emitter tips coupled with associated control electrodes.

In typical prior art devices, a field emission tip is characteristically arranged in electrical contact with an emitter conductor and in spaced relationship to an extraction electrode, thereby forming an electron emission gap. With a voltage imposed between the emitter tip and extraction electrode, the field emitter tip discharges a flux of electrons. The tip or tip array may be formed on a suitable substrate such as silicon or other semiconductor material, and associated electrodes may be formed on and/or in the substrate by well-known planar techniques to yield practical microelectronic devices.

Two general field emitter types are known in the art, horizontal and vertical, the direction of electron beam emission relative to the substrate determining the orientational type. Horizontal field emitters utilize horizontally arranged emitters and electrodes to generate electron beam emission parallel to the (horizontally aligned) substrate. Correspondingly, vertical field emitters employ vertically arranged emitters and electrodes to generate electron beam emission perpendicular to the substrate.

Examples of horizontal field emitters are disclosed in Lambe U.S. Pat. No. 4,728,851 and Lee et al U.S. Pat. No. 4,827,177. The Lambe and Lee et al structures are formed as a single horizontal layer on a substrate. An improved horizontal field emitter is disclosed in Jones et al U.S. Pat. No. 5,144,191.

Examples of vertical field emitters are disclosed in Levine U.S. Pat. No. 3,921,022; Smith et al U.S. Pat. No. 3,970,887; Fukase et al. U.S. Pat. No. 3,998,678; Yuito et al U.S. Pat. No. 4,008,412; Hoeberechts U.S. Pat. No. 4,095,133; Shelton U.S. Pat. No. 4,163,949; Gray et al. U.S. Pat. No. 4,307,507; Greene et al U.S. Pat. No. 4,513,308; Gray et al U.S. Pat. No. 4,578,614; Christensen U.S. Pat. No. 4,663,559; Brodie U.S. Pat. No. 4,721,885; Baptist et al U.S. Pat. No. 4,835,438; Borel et al U.S. Pat. No. 4,940,916; Gray et al. U.S. Pat. 4,964,946; Simms et al. U.S. Pat. 4,990,766; and Gray U.S. Pat. No. 5,030,895.

As further examples, Tomii et al U.S. Pat. No. 5,053,673 discloses the fabrication of vertical field emission structures by forming elongate parallel layers of cathode material on a substrate, followed by attachment of a second substrate so that the cathode material layers are sandwiched therebetween in a block matrix. Alternatively, the cathode material layer can be encased in a layer of electrically insulative material sandwiched in such type of block matrix. The block then is sectioned to form elements having exposed cathode material on at least one face thereof. In the embodiment wherein the cathode material is encased in an insulative material, the sliced members may be processed so that the cathode material protrudes above the insulator casing. The exposed cathode material in either embodiment then is shaped into emitter tips (microtip cathodes).

Spindt et al U.S. Pat. No. 3,665,241 discloses vertical field emission cathode/field ionizer structures in which "needle-like" elements such as conical or pyramidal tips are formed on a (typically conductive or semiconductive) substrate. Above this tip array, a foraminous electrode member, such as a screen or mesh, is arranged with its openings vertically aligned with associated tip elements. In one embodiment disclosed in the patent, the needle-like elements comprise a cylindrical lower pedestal section and an upper conical extremity, wherein the pedestal section has a higher resistivity than either the foraminous electrode or the upper conical extremity, and an insulator may be arranged between the conical tip electrodes and the foraminous electrode member. The structures of this patent may be formed by metal deposition through a foraminous member (which may be left in place as a counter-electrode, or replaced with another foraminous member) to yield a regular array of metal points.

A metal microtip process conventionally employed in the art to fabricate structures of the type disclosed in the Spindt et al. patent involves the initial fabrication of a basic structure on a substrate of a material such as glass, on which are successively deposited cathode, insulator and gate material layers. The uppermost gate material layer is photomasked, and RIE processed to form an opening in the gate material layer, exposing the underlying insulator layer. The underlying layer of insulator material, e.g., SiO2, is then etched by chemical etch or RIE technique, to yield a cavity below the gate layer opening and extending down to the cathode material layer. This cavity extends radially outwardly under the overlying gate layer, so that the latter forms an overhang over the cavity about its periphery.

Subsequently in this microtip emitter structure formation process, a parting layer is vacuum deposited on the gate layer by evaporation technique, at a shallow angle (e.g., along a direction which is 75 degrees from the central axis of the cavity). The microtip element then is formed in the cavity on the cathode layer with contemporaneous formation of a closure layer overlying the parting layer on the gate structure. Finally, the parting layer is electrochemically etched to remove the closure layer, and yield the final structure in which the gate layer forms a gate electrode structure overlyingly surrounding the conical emitter tip in the cavity.

Jones et al U.S. Pat. No. 5,371,431 discloses a vertical column emitter structure in which the columns include a conductive top portion and a resistive bottom portion, and upwardly vertically extend from a horizontal substrate. By this arrangement, an emitter tip surface is provided at the upper extremity of the column and the tip is separated from the substrate by the elongate column. An insulating layer is formed on the substrate between the columns. An emitter electrode may be formed at the base of the column and an extraction electrode may be formed adjacent the top of the column.

As described in Jones et al U.S. Pat. No. 5,371,431, the vertical column emitter structure may be fabricated by forming the tips on the face of the substrate, followed by forming trenches in the substrate around the tips to form columns having the tips at their uppermost extremities. Alternatively, the vertical column emitter structure of U.S. Pat. No. 5,371,431 is described as being fabricatable by forming trenches in the substrate to define columns, followed by forming tips on top of the columns. In either method, the trenches may be filled with a dielectric and a conductor layer may be formed on the dielectric to provide extraction electrodes.

Further improvements in vertical field emitter structures and fabrication methods are disclosed in Jones U.S. patent application Ser. No. 029,880, filed Mar. 11, 1993, entitled "Emitter Tip Structure and Field Emission Device Comprising Same, and Method of Making Same," and in corresponding International Application Number PCT/US94/02669, published on 15 Sep. 1994 as International Publication WO 94/20975.

SUMMARY OF THE INVENTION

By the present invention, a number of structures are provided which enhance the performance and reliability of field emitter devices, particularly field emitter displays. The invention additionally provides methods for fabricating the structures.

More particularly, the invention provides various improved structures and methods for readily fabricating arrays of field emitter elements in a base structure, in which the field emitter elements have superior uniformity of shape and dimensional character, and resulting enhanced utility for field emitter displays, as compared to field emitter elements formed by prior art fabrication techniques.

DETAILED DESCRIPTION OF THE INVENTION, AND PREFERRED EMBODIMENTS THEREOF

The present invention relates to a planarization structure for flat-panel video displays using field emitters as electron emitters. The structure (and its variants) permit ease of connection of X and Y grid lines into the active area of a matrix address display.

The insulator stack combination provides for improved isolation between the gate and emitter lines in the vacinity of the emitters by creating an isolation cavity with a long insulator surface up to 2–5 times the thickness of the dielectric, thereby greatly reducing the probability of current leakage across the surface of the insulator near the emitters (due to reduced electric field across the dielectric walls).

Other advantages of the improved field emitter structure of the invention include the following:

- it provides increased physical support of the gate conductor using the upper dielectric layer
- it permits a smoothed surface to be used for the emitter patterning step
- conductive defects are coated in the fabrication of the structure, reducing the probability of electrical shorts resulting from such conductive defects
- the field emitter structure in a preferred embodiment uses spin-on planarized silicon dioxide as part of insulator structure in a unique manner.

Key structural components of an exemplary planarizing structure according to the present invention are:

- a spin-on planarizing insulator
- an overlayer of slow etching dielectric
- an etched cavity into the dielectric stack creating a C-shaped cavity with a long dielectric on top
- the accommodation of multiple material layers, thereby building focusing electrodes In another aspect, the invention contemplates a liftoff structure for fabricating evaporated emitters into the cavities formed in the basic structure.

Key structural components include a multilayer directionally deposited stack comprising:

1. A gate conductor (or combination of conductors) e.g., formed of Cr or other useful gate material of construction
2. A release layer (e.g., formed of Cu) which can be selectively etched without attack of the gate material
3. An optional upper/side veil material with acts to protect the surface sidewalls of the release layer and gate during cavity etching
4. An intermediate lithographic liftoff column to create an array of holes when the gate material and release/veil material is deposited.

The foregoing features and aspects are more fully illustrated in the ensuing disclosure, and with reference to the exemplary process embodiments set out hereinafter.

Figure 1:
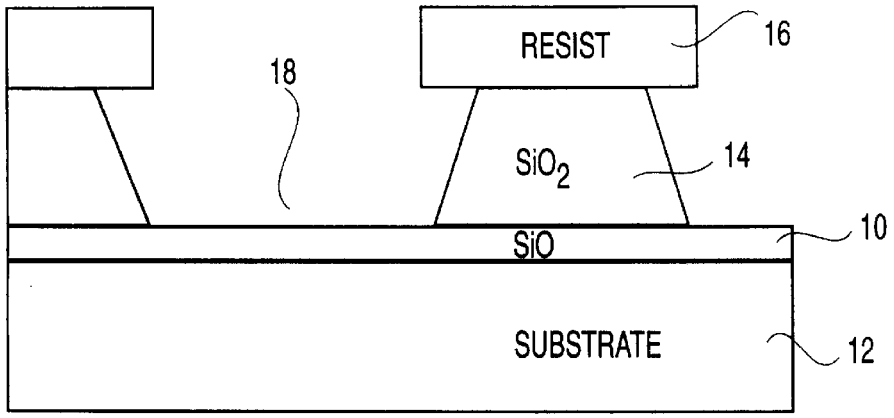
FIGS. 1–3 depict a process for forming a base structure for subsequent fabrication of emitter tip elements thereon.
Figure 2:
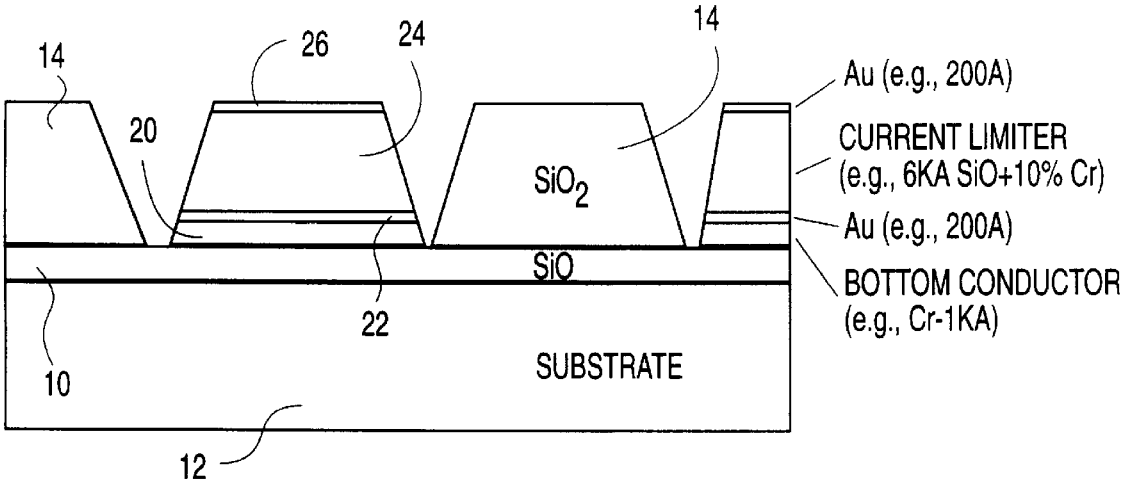
Figure 3:
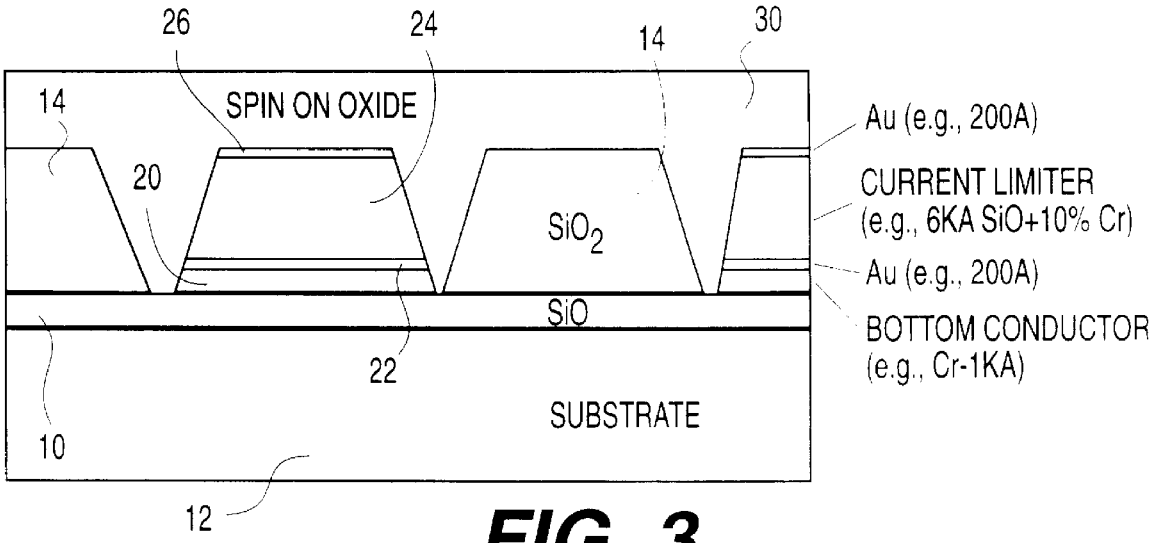

In an illustrative process according to one embodiment of the invention, the field emitter array is formed by the following process steps, as referenced to FIGS. 1–3 hereof.

1. Depositing an etch stop layer 10 (FIG. 1), e.g., of SiO, $Si_3N_4$, or $Al_2O_3$, on a glass substrate 12 (e.g., with the etch stop layer 10 having a thickness of 0.1 to 2 micron), then depositing a layer 14 of $SiO_2$ or other suitable insulator material over the etch stop layer to approximately the thickness (e.g., 1 micron) of the subsequently deposited conductor and current limiter layers taken together.
2. Patterning the structure formed in step 1 with a photoresist 16 and etching trenches 18 down to the etch stop layer 10 through the silicon dioxide layer 14 (via RIE, plasma, or buffered oxide etch, or a combination of these etching techniques). Overetching is carried out sufficiently to remove SiO2 at the base of the etched cavities so as to accurately set the height of the trench.
3. Depositing a bottom conductor material 20, e.g., chromium at a thickness of 1000 Angstroms, and then a layer 24 of a current limiter material such as a layer of SiO+ 10% wt. chromium based on the weight of the SiO, at a thickness of for example 6000 Angstroms. The deposition of the current limiter material layer may optionally be preceded and followed by deposition of injector material layers 22 and 26, e.g., of gold or aluminum, at a thickness on the order of 200 Angstroms, depending on the characteristics desired in the product structure (see FIG. 2). Such deposition may be carried out by any suitable method, such as by sputtering or evaporation technique. For example, an Au—(SiO+Cr)—Au film layer structure as shown in FIG. 2 may be employed for a peak current vs voltage device. The top layer may be a combination of etch stop and/or carrier injector layers. The current limiter layer may be masked off the ends of the leads to facilitate subsequent connection of the product display to associated electronics components and circuitry.

4. Removing the resist 16 with solvent and liftoff the deposited layers, yielding the structure shown in FIG. 2.
5. Spin-on of a planarizing oxide layer 30 (see FIG. 3), of a material such as Dow-Corning FOX (e.g., at a 0.5–2 micron thickness), bake 1 hour at 450 degrees C. after slow temperature ramp (3 degrees per minute) to cure. The spin on material may be deposited in multiple coats with intermediate baking steps in the fabrication of this oxide material layer. The resulting structure is shown in FIG. 3.

Figure 4:
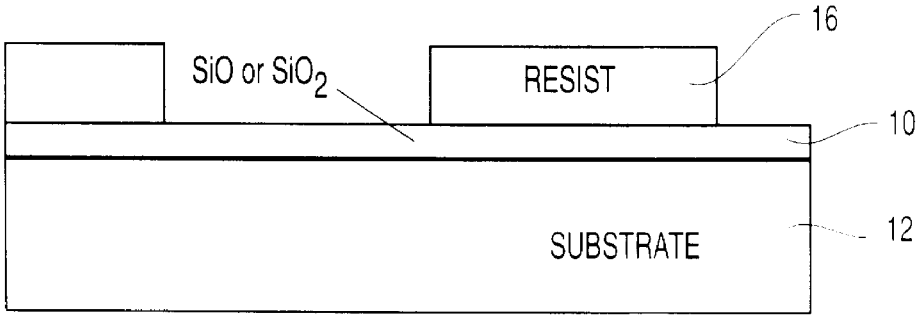
FIGS. 4–6 depict an alternative process to that shown in FIGS. 1–3 for forming a base structure for subsequent fabrication of emitter tip elements thereon.
Figure 5:
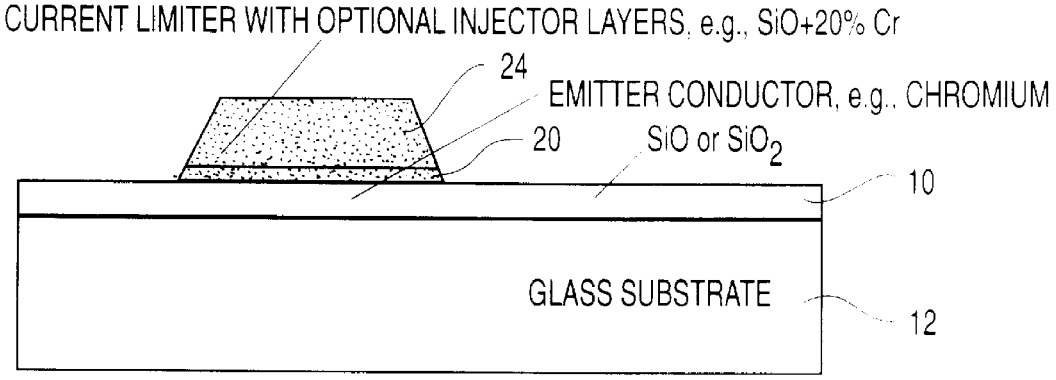
Figure 6:
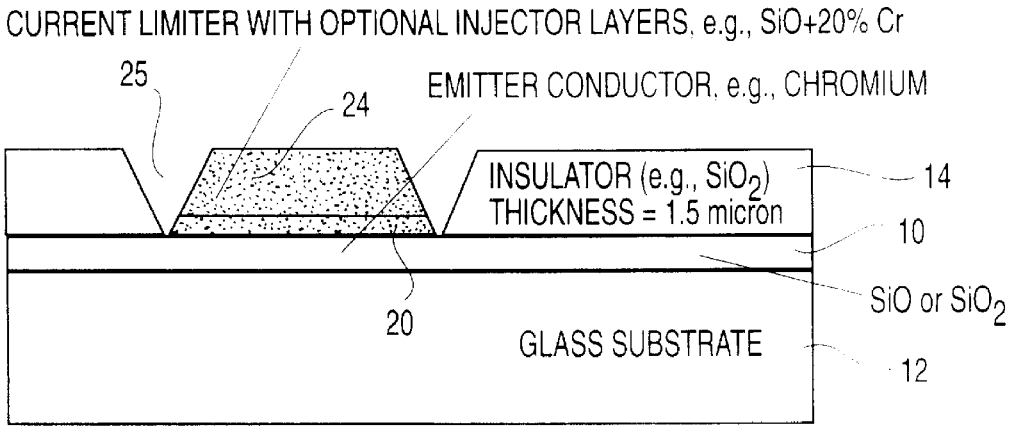

FIGS. 4–6 depict an alternative process for forming a base structure of the same general type as results from the process depicted in FIGS. 1–3. In this alternative process, as described with reference to FIGS. 4–6, the following steps are carried out:

1. Coating resist 16 on the prepared substrate (e.g., a clean glass substrate 12 with an optional pure coating 10 of silicon dioxide or SiO as shown in FIG. 4).
2. Depositing the emitter line metal 20, e.g., chromium, and current limiter layer 24 and carrying out liftoff of the resist (in a suitable solvent such as NMP with an IPA rinse) along with the excess metal, yielding the structute shown in FIG. 5. The current limiter may comprise optional injector layers, e.g., of SiO+20% chromium (wherein the percent of chromium is by weight, based on the weight of the SiO).
3. Coating the structure resulting from step 2 with an ~2 micron thickness of a positive resist, baking the resist-coated base, and exposing the resist from the backside using a light source (e.g., a Hg lamp ), developing the exposed resist in a suitable basic developer and baking the resulting structure.
4. Depositing insulator 14 onto the front side of the base structure (e.g., SiO2 at a thickness of 1.5 micron) at the same thickness as the combined current limiter 24 and emitter metal 20 thickness, and then carrying out liftoff of the resist 16 with the excess insulator, in a solvent such as NMP with an IPA rinse.
5. Depositing a spin-on-oxide (not shown in FIG. 6) to fill in the gaps 25 between the conductor 20/current limiter 24 structures and the deposited insulator 14, and baking/annealing as in the process described in connection with FIGS. 1–3 to achieve a similar resulting base structure.

Figure 7:
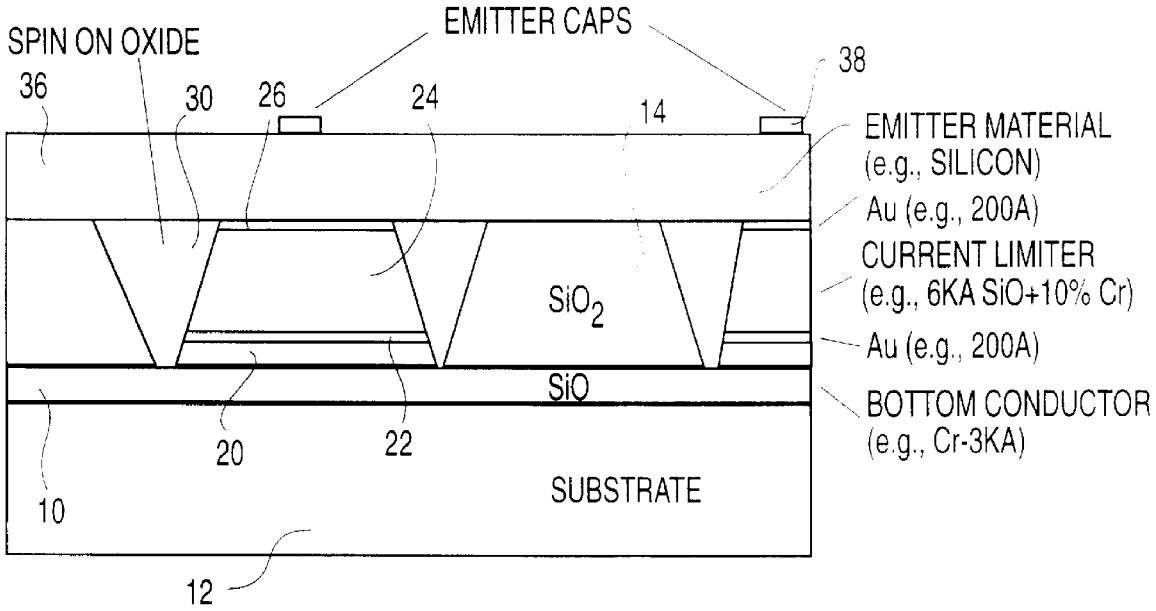
FIGS. 7–9 depict the etch formation of emitter tip elements on a base structure of the type formed via the processes of FIGS. 1–3 or FIGS. 4–6.
Figure 8:
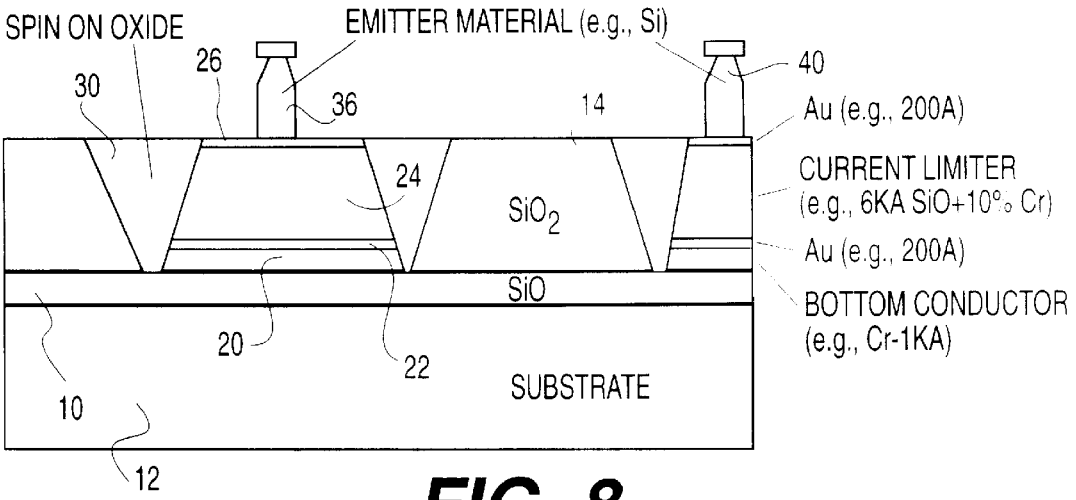
Figure 9:
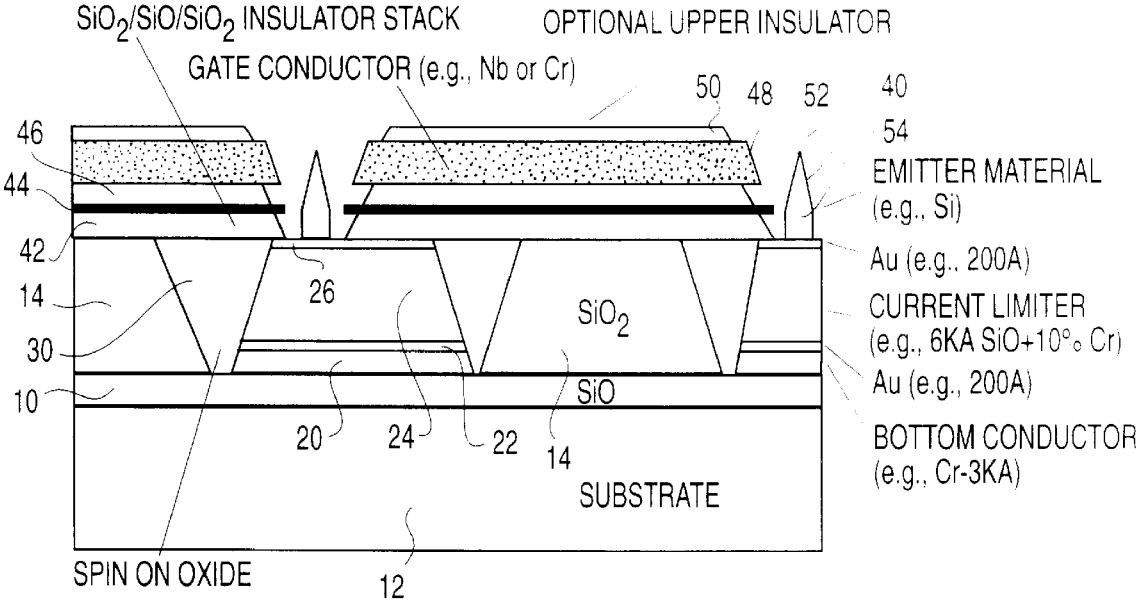

The base structures resulting from the alternative processes described hereinabove with reference to FIGS. 1–3, and with reference to FIGS. 4–6, respectively, may then be utilized in the formation of field emitter elements thereon, as now described with reference to FIGS. 7–9. The etched emitter tip formation process comprises the steps set out below:

A.1. Etching back or polishing the spin on oxide 30 to expose the top of the current limiter material 24 or the surface of the injector layer 26 (depending on whether the current limiter material includes an injector layer associated therewith).

A.2. Optionally depositing an injector layer if not done in a preceding step unless the emitter material adequately serves this purpose (e.g., silicon with gold doping serves this purpose), and then depositing the emitter material 36, such as silicon or molybdenum (see FIG. 7).

A.3. Liftoff patterning the emitter material layer 36 with a suitable patterning material, and depositing etch resistant caps 38 (e.g., at a thickness of 50 nm to 2,000 nm) thereon, as shown in FIG. 7.

A.4. Etching the emitter material 36 first isotropically then anisotropically to form emitters 40, as shown in FIG. 8, and depositing the insulator layers 42, 44, and 46 (e.g., layers 42 and 46 of SiO, and layer 44 of $SiO_2$) to provide the insulator stack SiO2/SiO/SiO2 as shown in FIG. 9.

A.5. Patterning the gate lines for deposition of conductor 48 which may comprise a metal such as Nb or Cr, and carrying out liftoff or etch of the gate lines, followed by etching of the emitter material 36 to sharpen the points 52 and liftoff the caps 38 to complete the emitter array, yielding the product field emitter array article shown in FIG. 9, including a multiplicity of emitter elements 40 each having a cylindrical lower portion 54 and a sharpened tip portion 52.

In accordance with another aspect of the invention, field emitter elements are formed on a base structure by an evaporation process with shielding of portions of the nascent structure during the fabrication by a protective material layer, such process being described below with reference to FIGS. 10–16 and referred to hereinafter as the "veil process" of the invention.

Figure 11:
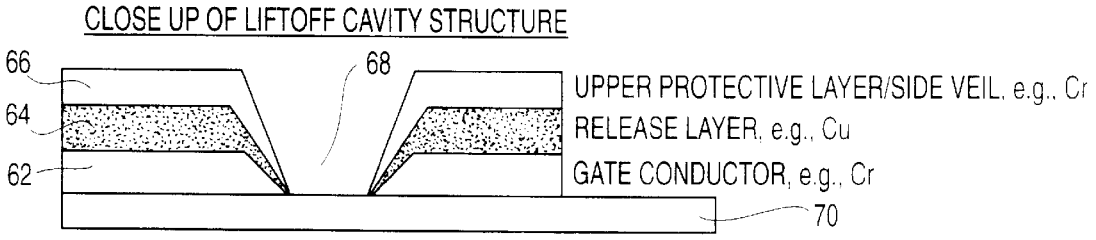
Figure 12:
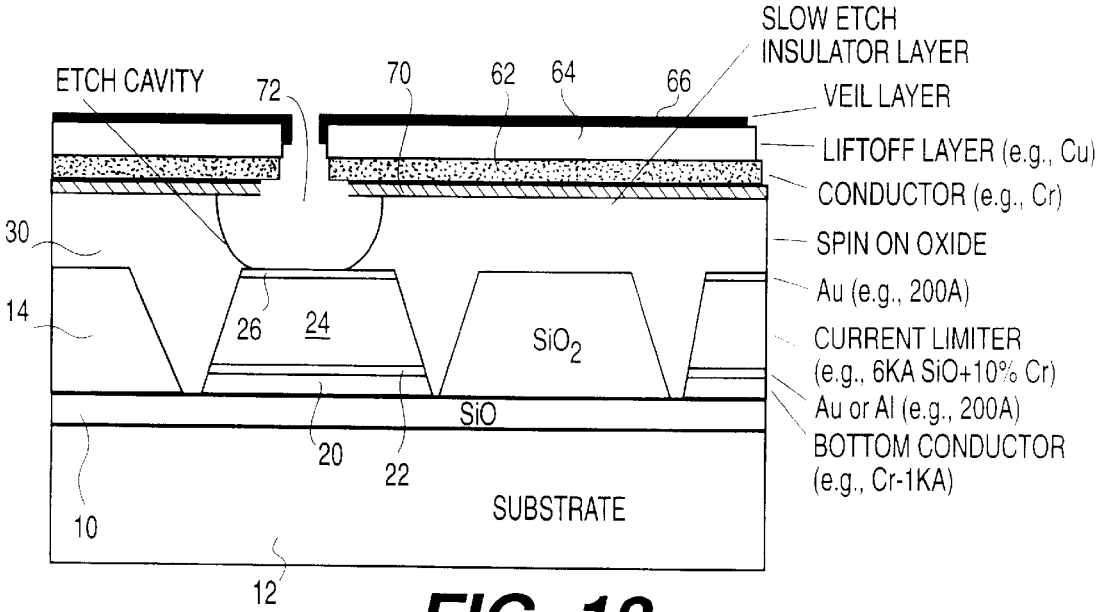
Figure 13:
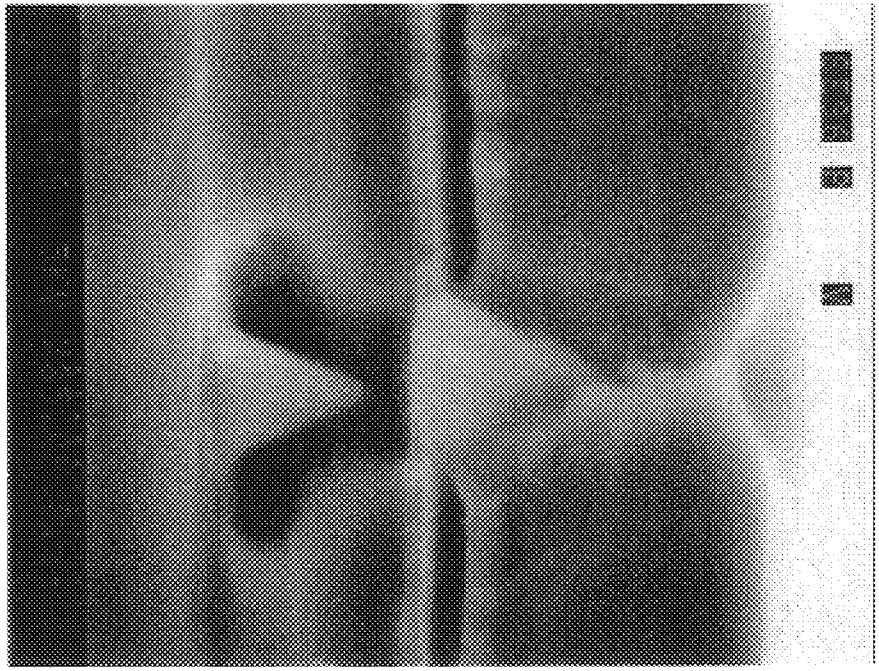
Figure 14:
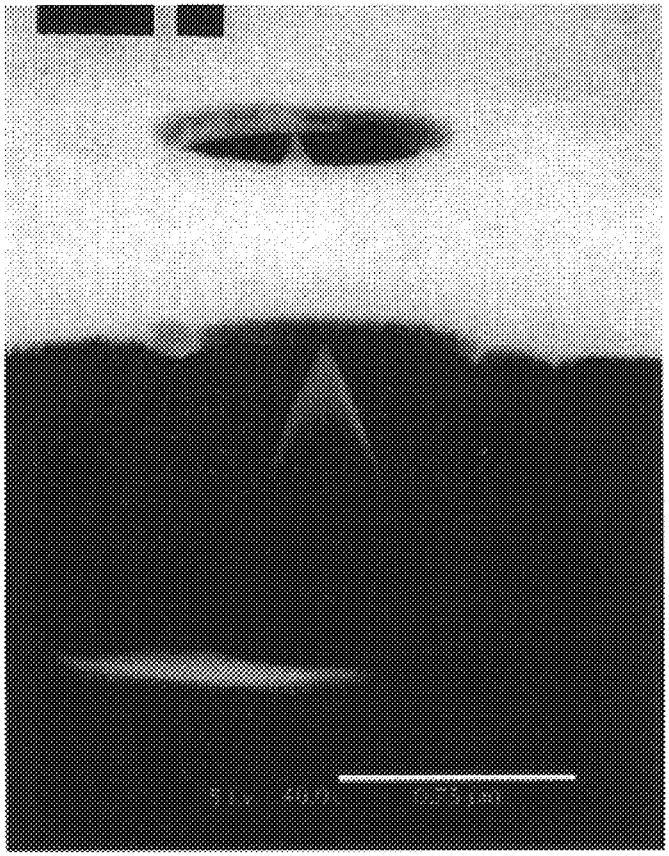

In these Figures, FIGS. 10–16 depict the evaporation formation of emitter tip elements on a base structure of the type formed via the processes of FIGS. 1–3 or FIGS. 4–6, with FIGS. 10–12 and 15–16 showing schematically the structures in the process flow, and with FIGS. 13 and 14 showing photomicrographs of the "veiled" precursor structure of the field emission array (FIG. 13) and of the final field emission array structure (FIG. 14).

In the practice of the veil process, beginning with a base structure such as formed by the process embodiments illustratively described hereinabove in connection with FIGS.1–3 and FIGS. 4–6 (see FIG. 10), the top surface of the dielectric (spin on oxide) material, layer 30, optionally augmented by the slow etch SiO+SiO2 layer 70, is patterned with a photoresist material, subsequent to which a conductor layer 62 (e.g., of chromium) and a liftoff layer 64 (e.g., of copper) are deposited by sputtering or evaporation. A suitable solvent then is used to liftoff dots of photoresist and metal on top of such dots, leaving an array of holes in the metal and liftoff layer film. Deposition, pattern, and etch process sequences of varying types may be employed for the purpose of creating a corresponding variety of different structures. Groups of pixels may be patterned in the practice of such fabricational methods, using conventional lithography techniques with steppers, scanners, or holography systems.

The above-mentioned patterns deriving from photoresist patterning of the insulator layer may be exposed in the deposited photoresist using interfered laser beams, since the substrate is free of surface roughness due to the spin-on (oxide deposition) planarization techniques employed. The laser radiation exposure with the interfered laser beams, to carry out the interferometric lithography on the photoresist-coated oxide layer, may by way of example be performed by exposing a line and space interference pattern from a krypton laser (wavelength=~416 nm) or an argon laser (wavelength=~351 nm), rotating the substrate 90 degrees, and then reexposing the substrate to laser radiation. A laser interference feedback development system may be advantageously utilized. As a further preferred aspect of such fabricational method, an antireflective layer of a material such as polyimide may be employed, with the antireflective material layer underlying the photoresist. Self-alignment of pixels can be achieved where the emitter leads and gates overlap, even if a coverall dot array pattern is used.

In this interfered laser beam lithographic method, a lithographic mask pattern in addition to the emitter dots may be used to shape arrays of dots into groupings. This mask may also be used to create large dot or line patterns which do not close up during the subsequent emitter material deposition, thereby enhancing the rate and ease of emitter liftoff.

The optional second layer of dielectric 70 may be deposited after curing of the spin-on dielectric (second layer 30 of dielectric shown in FIG. 10), and can be SiO, SiO2, an SiO+SiO2 mixture, or other suitable dielectric material.

Figure 10:
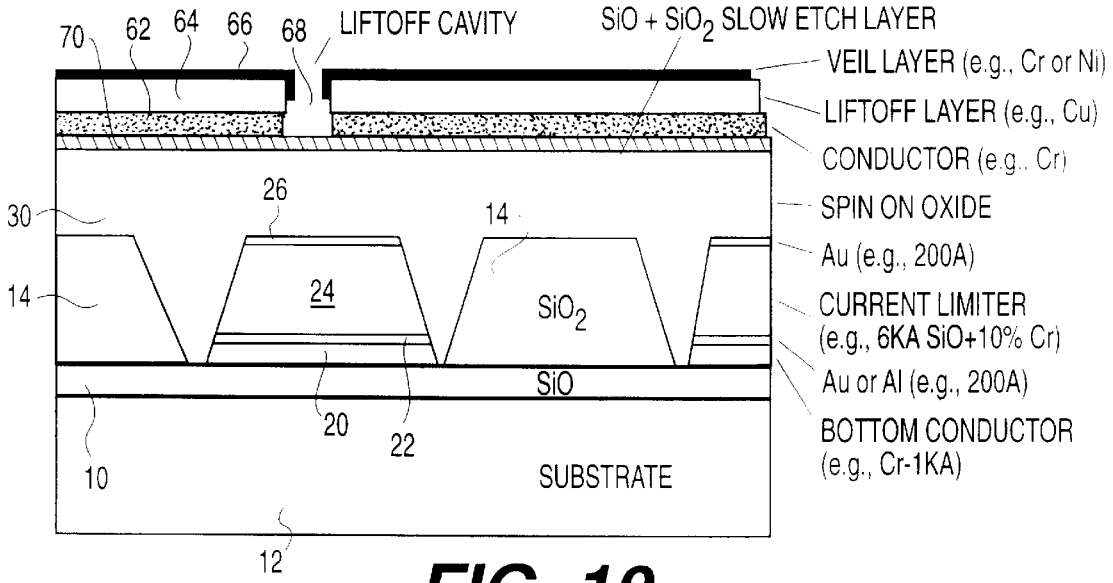
FIGS. 10–16 depict the evaporation formation of emitter tip elements on a base structure of the type formed via the processes of FIGS. 1–3 or FIGS. 4–6, with FIGS. 10–12 and 15–16 showing schematically the structures in the process flow and with FIGS. 13 and 14 showing photomicrographs of the "veiled" precursor structure of the field emission array and of the final field emission array structure.

By depositing the gate layer 62, release layer 64, and optional upper liftoff layer 64/veil layer 66 at slight angles to the surface of the structure on which the deposition is carried out, a precursor article as shown in FIG. 10 is fabricated. This precursor article provides an ideal liftoff structure for a subsequently evaporatively formed emitter, and enables a fabricational method which is substantially simpler and easier to implement than the prior art methods for forming microtip emitter arrays using shallow angle evaporations.

Sputtering of the gate layer 62, release layer 64, and optional upper liftoff layer 64/veil layer 66 may also be used to create multiple constituent layers as long as build-up of deposited material on the walls of the liftoff columns is suitably controlled with relatively low pressures, as may readily be determined without undue experimentation by those skilled in the art to identify the optimal pressure and other operating conditions for such methodology. In the practice of this methodology, it has been to be generally advantageous to deposit the release layer 64 and the protective layer (comprising the optional upper liftoff layer 64 and the veil layer 66) at slightly shallower evaporation angles than the angle employed in the deposition of the gate metal layer 62).

The upper veil portion 66 of the protective layer (comprising the optional upper liftoff layer 64 and the veil layer 66) is optional, but helps reduce the sensitivity of the release layer to corrosion during intermediate processing. This veil layer 66 may be formed of any suitable material of construction which is compatible with the liftoff (release) layer 64, and is protectingly effective for the gate conductor layer 62, under the fabricational process conditions to which the veil layer is subjected. Preferred veil layer 66 species include chromium and nickel. FIG. 10 shows the upper portion of the structure as comprising a liftoff cavity 68, which may be formed by any suitable technique, such as RIE, plasma or wet etching techniques, using an etchant medium which is employed after the formation of the liftoff layer 64 but before the formation of the veil layer 66 to etch through the liftoff layer 64 and the conductor layer 62, so that subsequent deposition of the veil layer 66 can be carried out in a manner so that the veil material forms an overcoated portion on the side walls of the liftoff cavity 68 over the liftoff layer as shown in FIG. 10.

The protective layer comprising the optional upper liftoff layer 64 and the veil layer 66 is shown in further detail in FIG. 11, together with the associated gate conductor layer 62, and the slow etch insulator layer 70 (which as mentioned above may comprise Si+SiO2, or other suitable insulator material). As shown in FIG. 11, the protective veil and release material layers cover the edge of the gate conductor layer 62 and the upper protective veil layer 66 ensures that the release layer 64/gate layer 62 is protected at its edge during the cavity etches using RIE, plasma or wet etching. Accordingly, when the emitter material is later deposited in the cavities, excess emitter material will build up on the veil or liftoff layer, and not on the gate edge, thereby promoting a later clean liftoff of the excess emitter material. In this manner, both the release layer 64 and the veil layer 66 are used to create a thin veil structure, which only slightly restricts the cross-sectional area of the emitter cavity and which nonetheless can be lifted off readily in subsequent processing.

Next, a cavity etch step is carried out to form cavities in the dielectric layers 70 and 30, using any suitable etchant medium and technique which is efficacious for such purpose. By way of example, such etching may be carried out using RIE (e.g., with CF4 as the reagent therefor), or via wet processing technique such as BOE, or by a combination of such methods. A wet etch step is preferably used to finish such etching operation, to ensure a clean etch stop on the current limiter material 24/injector layer 26. The resulting cavity-etched structure is shown in FIG. 12, comprising cavity 72.

Subsequent to the formation of the cavities 72 in the dielectric (oxide) layer 30, an emitter material is deposited down into the cavities. The emitter material may be of any suitable material of construction usefully employed in the art for the formation of field emitter elements. By way of example, the emitter material may comprise silicon, or a material such as SiO+50% Cr. The emitter material is deposited by evaporation at low pressure (e.g., $<10^{-5}$ torr) until the "holes" of the cavity entrances close off, thereby forming a pointed emitter tip under the "close-off" excess emitter material as shown in the photomicrograph of FIG. 13 , wherein the precursor article is shown in elevational section, as cut to reveal the interior features of the emitter element and cavity structure. This micrograph is taken at 35.0K magnification, and shows the extremely uniform structural characteristics of the emitter element, and the overlying conformation of the protective layer comprising the liftoff (release) layer and the veil layer.

After formation of the structure shown in the photomicrograph of FIG. 13, the liftoff layer (together with the optional veil layer, if present) is removed, to "reopen" the entrance to the cavity 72. Such protective layer removal may be effected with any suitable reagent which is efficacious for such purpose, with the specific reagent being readily determinable without undue experimentation by those skilled in the art depending on the specific composition of the protective layer. By way of example, nitric acid may be used to release the excess emitter material if a copper liftoff layer is used, and other acid or nonacid removal species may be advantageously employed for other release layer materials.

In removing the protective layer comprising the constituent liftoff layer and (optional) veil layer together with the excess emitter material overcoated thereon, short etches of the gate material layer may be used to separate spurious emitter material depositions on the gate edge. An illustrative etch protocol for such removal is etch removal of ~0.25 nm of material thickness where chromium is the gate emitter layer material utilizes potassium permanganate solution 10 wt % in water with ultrasonic agitation at 25° C.

FIG. 14 is a photomicrograph of the resulting field emitter array structure, taken at a magnification of 40.0K. This micrograph shows the emitter tip element in the cavity of the base structure, with the tip element being overlyingly surrounded by the gate electrode layer, and with the cavity being of smoothly concave contour in the elevationally sectioned view illustrated in the micrograph. The cavity is etched back in the spin-on oxide material layer, so that the overlying dielectric (slow etch material) forms an overhang, and extends the current leakage path between the emitter tip element and the gate electrode, with the slow etch dielectric layer being in turn etched back in relation to the gate electrode layer, so that the gate electrode layer edge at the opening of tip-containing cavity is in appropriate close proximity to the tip element's upper distal end, for highly efficient stimulation of electron emission, at low turn-on voltage, in the operation of the resulting field emission array device.

Figure 15:
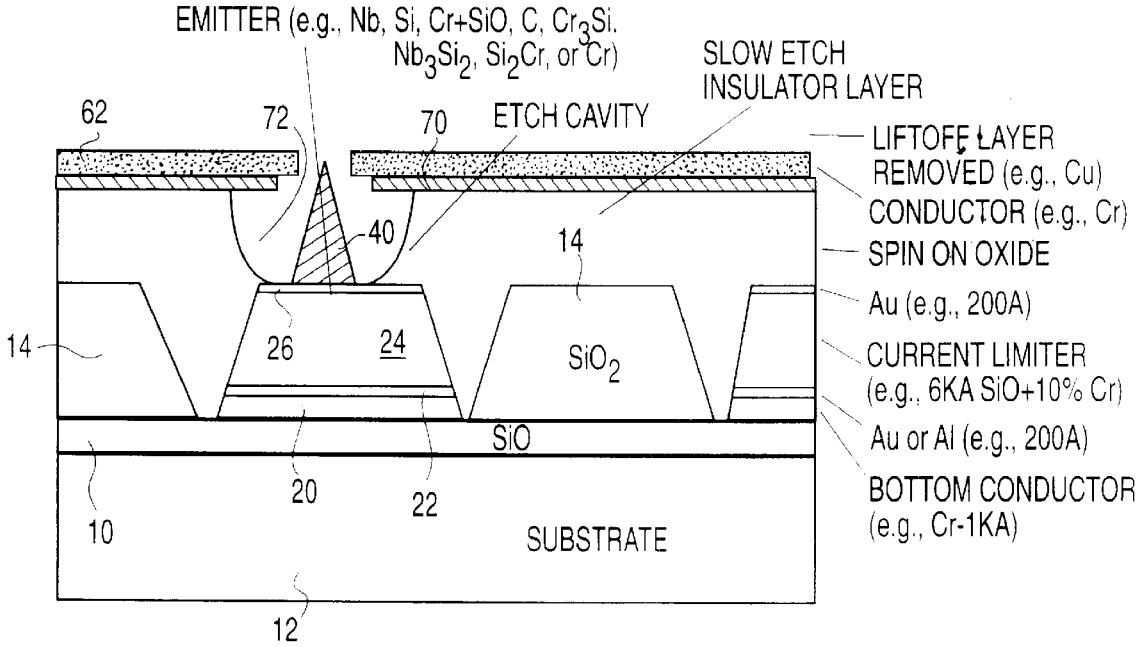
Figure 16:
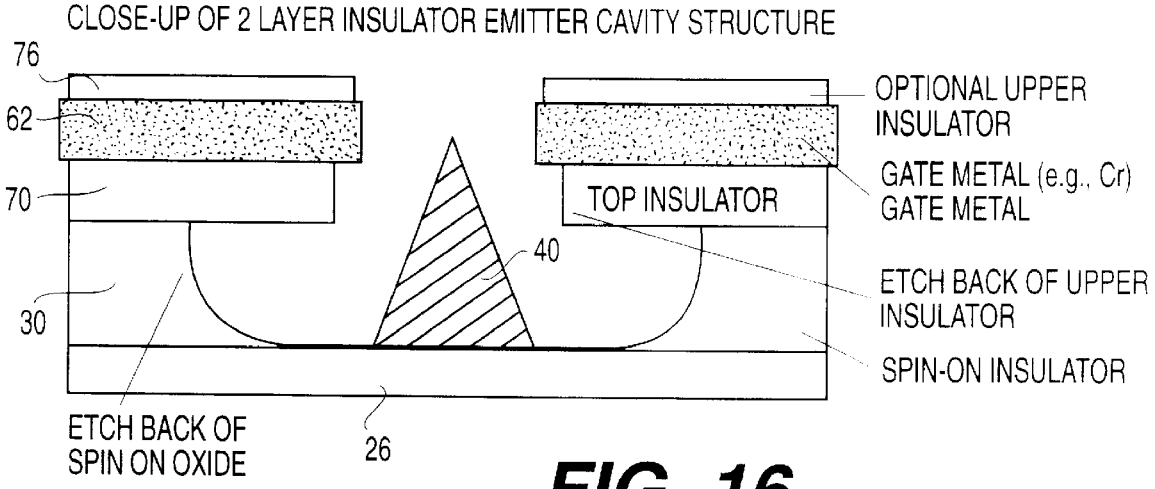

The details of the field emitter array structure illustrated in the micrograph of FIG. 14 is shown schematically in FIG. 15, and an enlarged elevational view of the cavity portion of such structure is shown in FIG. 16.

As shown in FIGS. 15 and 16, the field emitter array structure comprises the emitter tip element 40 on the injector layer 26 in the cavity 72 formed in the spin on oxide layer 30. The emitter tip element is overlyingly surrounded by the gate electrode 62, beneath which, interposed between the gate electrode and the spin on oxide layer 30, is the slow etch insulator layer 70. The insulator layer 70 is differentially etched back from the periphery of the gate electrode surrounding the upper opening of the cavity 72, so that the gate electrode overhangs the slow etch insulator layer 70. The slow etch insulator layer 70 in turn, as a result of its slower etch character relative to the spin on oxide layer 30, overhangs the spin on oxide at the opening to cavity 72 to provide an extended current leakage path as previously discussed herein.

The emitter element 40 thus is reposed on a pedestal structure comprising bottom conductor 20, injector layer 22, current limiter layer 24, and injector layer 26. Such pedestal structure in turn reposes on the dielectric layer 10 formed on the top surface of substrate 10.

The emitter element pedestal support structure on the dielectric layer 10 alternates across the surface of layer 10 with mesa-shaped pedestals 14 of insulator material, with the interstices between these successively alternating pedestals being in-filledwith the spin on oxide layer 30.

FIG. 16 shows a close-up enlarged view of the emitter tip element and the surrounding portion of the field emission array structure. As shown in FIG. 16, the emitter tip element 40 is supported on the optional injector layer 26, and in the absence of such layer, the base extremity of the emitter tip element would repose on the top surface of the current limiter layer 24. The spin on insulator layer 30 is overlaid and overhung by the top insulator layer 70, and the top insulator layer in turn is overlaid and overhung by the gate electrode layer 62. The gate electrode layer may as shown in FIG. 16 have a layer 76 of an insulator material thereon, for the purpose of enhancing the relative electrical isolation of the gate electrode in the overall structure.

In the formation of emitter elements in the practice of the invention, it may be advantageous in some instances to overcoat the emitter tip element with an emitter coating of a suitable low work function material to reduce the work function if a high work function material (e.g., SiO+Cr, or a diamond like film) was employed to form the emitter in the first instance. A sidewall cleanup in the cavity containing the overcoated emitter tip element then may be advantageously carried out, after deposition of the low work function material, to remove the excess low work function material from the sidewalls of the cavity, thereby reducing the gate to emitter electrical leakage which might otherwise be increased in the absence of removal of the excess low work function material.

Suitable low work function coating materials for overcoating the emitter tip elements include: SiO+15–80% (by wt., based on the SiO) of chromium; chromium silicides; niobium silicides; or other stable low work function silicides which are oxidizable in air between 350 degrees C. and 1000 degrees C. (e.g., per a period on the order of 1–12 hours), with 400–500 degrees and an oxidation processing time on the order of 1–4 hours preferred due to the compatibility of such process conditions with the usage of low cost glass as a substrate material.

After formation of the field emission array as described hereinabove is completed, the emitter lines are then lithographically patterned and etched, with an appropriate etchant medium for the emitter line material employed. By way of illustration, potassium permanganate aqueous solution may be employed to etch chromium emitter lines.

Concerning other variations and modifications within the broad scope of the invention that may be utilized in the fabrication of the field emission array product and flat panel display products comprising same, the gate lines for the field emitter array may be deposited from chrome, with a thin gold layer to enhance contact to external leads, by any suitable technique, such as evaporation or sputtering. A thin nickel layer may be deposited over the chromium gate material or in place of the chromium gate material and then immersion coated with gold. Electroless gold or nickel may be used to constrict the gate opening and thicken the gate metal for enhanced conductivity after the leads are patterned.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A field emitter device precursor article for use in forming a field emitter device, said precursor article comprising:

a substrate;

an insulator material formed on said substrate, said insulator material defining a cavity having a base capable of receiving a field emitter element formed thereon through vapor phase deposition, said cavity having an upper opening formed therein spaced from said base, said upper opening being adapted for discharge of electrons from the field emitter element through said upper opening;

a gate conductor layer formed on said insulator material spaced from said base, said gate conductor layer circumscribing and extending over a portion of said upper opening and defining a circumscribing peripheral edge in spaced relationship to the field emitter element when the field emitter element is formed on said base, said circumscribing peripheral edge in turn defining an opening in said gate conductor layer which is aligned with said upper opening of said cavity; and a temporary protective layer formed over said gate conductor layer, said temporary protective layer including a liftoff layer formed on said gate conductor layer that extends over said circumscribing peripheral edge of said gate conductor layer, wherein said protective layer restricts deposition of field emitter element forming material on said gate conductor layer circumscribing peripheral edge during formation of the field emitter element on said base.

2. A field emitter precursor article according to claim 1, wherein said temporary protective layer further comprises a veil layer formed over said liftoff layer, wherein said veil layer also overlying said gate conductor layer circumscribing peripheral edge.

3. A field emitter precursor article according to claim 2, wherein the veil layer comprises a metal selected from the group consisting of chromium and nickel.

4. A field emitter precursor article according to claim 1, wherein said liftoff layer comprises copper.

5. A field emitter precursor article according to claim 1, wherein said temporary protective layer is removed from said field emitter precursor article during formation of said field emitter device.

6. A field emitter device precursor article for use in forming a field emitter device, said precursor article comprising:

a substrate;

an insulator material on said substrate, said insulator material defining a cavity having a base capable of receiving a field emitter element formed therein, said cavity having an upper opening spaced from said base, said upper opening being adapted for discharge of electrons from the field emitter element through said upper opening;

a gate conductor layer formed on said insulator material, said insulator material circumscribing and extending over a portion of said opening and a field emitter element formed on said base and, said gate conductor layer defining a circumscribing peripheral edge in spaced relationship to said field emitter element, said circumscribing peripheral edge in turn defining an opening in said gate electrode layer which is aligned with said upper opening of said cavity;

a temporary protective layer formed over said gate conductor layer, said protective layer including a liftoff layer formed on said gate conductor layer that extends over said circumscribing peripheral edge of said gate conductor layer, wherein said temporary protective layer restricts deposition of field emitter element forming material on said gate conductor layer circumscribing peripheral edge during formation of said field emitter element on said base;

a field emitter element formed on said base within said cavity by depositing field emitter element forming material on said base, and an overlayer of excess deposited field emitter element forming material on said temporary protective layer, wherein said overlayer at least partially occludes said upper opening of said cavity.

7. A field emitter precursor article according to claim 6, wherein said temporary protective layer further comprises a veil layer formed over said liftoff layer between said liftoff layer and said overlayer, wherein said veil layer also overlying said gate conductor layer circumscribing peripheral edge.

8. A field emitter precursor article according to claim 6, wherein said liftoff layer comprises copper.

9. A field emitter precursor article according to claim 7, wherein the veil layer comprises a metal selected from the group consisting of chromium and nickel.

10. A field emitter precursor article according to claim 6, wherein said temporary protective layer and said overlayer are removed from said field emitter precursor article during formation of said field emitter device.

* * * * *